US008193946B2

(12) United States Patent
Sinanovic et al.

(10) Patent No.: US 8,193,946 B2
(45) Date of Patent: Jun. 5, 2012

(54) TRAINING FOR DIRECTIONAL DETECTION

(75) Inventors: Sinan Sinanovic, Sarajavo (BA); Donald H. Johnson, Houston, TX (US); Wallace R. Gardner, The Woodlands, TX (US); Li Gao, Missouri, TX (US); Carl A. Robbins, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 941 days.

(21) Appl. No.: 12/065,529

(22) PCT Filed: Nov. 10, 2006

(86) PCT No.: PCT/US2006/060795

§ 371 (c)(1),
(2), (4) Date: Aug. 1, 2008

(87) PCT Pub. No.: WO2007/059442

PCT Pub. Date: May 24, 2007

(65) Prior Publication Data

US 2008/0285386 A1 Nov. 20, 2008

Related U.S. Application Data

(60) Provisional application No. 60/736,104, filed on Nov. 10, 2005.

(51) Int. Cl.
*H04H 9/00* (2006.01)

(52) U.S. Cl. ..... 340/855.4; 367/82

(58) Field of Classification Search ..... 367/82; 340/854.3, 855.4

See application file for complete search history.

(56) References Cited

U.S. PATENT DOCUMENTS

| | | | | |
|---|---|---|---|---|
| 2,810,546 | A | | 10/1957 | Eaton et al. |
| 3,305,771 | A | | 2/1967 | Arps |
| 3,588,804 | A | | 6/1971 | Fort |
| 3,716,830 | A | | 2/1973 | Garcia |
| 3,747,059 | A | | 7/1973 | Garcia |
| 3,790,930 | A | | 2/1974 | Lamel et al. |
| 3,813,656 | A | | 5/1974 | Fowler |
| 3,973,181 | A | | 8/1976 | Calvert |
| 4,282,588 | A | | 8/1981 | Chanson et al. |
| 4,283,779 | A | | 8/1981 | Lamel |
| 4,302,826 | A | | 11/1981 | Kent et al. |
| 4,314,365 | A | | 2/1982 | Petersen et al. |
| 4,468,623 | A | | 8/1984 | Gianzero et al. |
| 4,590,593 | A | | 5/1986 | Rodney |
| 5,222,048 | A | * | 6/1993 | Grosso et al. ..... 367/32 |
| 5,235,285 | A | | 8/1993 | Clark et al. |
| 5,467,320 | A | | 11/1995 | Maki |

(Continued)

OTHER PUBLICATIONS

"US Non-Final Office Action", dated May 25, 2005, U.S. Appl. No. 10/897,559, filed Jul. 23, 2004 (Patent No. 7,158,446).

(Continued)

*Primary Examiner* — John Kreck
(74) *Attorney, Agent, or Firm* — Krueger Iselin LLP

(57) ABSTRACT

Acoustic telemetry devices and methods that provide directional detection. In one embodiment, a disclosed acoustic telemetry device comprises at least two acoustic sensors and an electronics module. The electronics module combines the detection signals from the acoustic sensors to obtain a combined signal that substantially excludes signals propagating in a direction opposite to the communication signal. The disclosed systems and methods can be trained in the field and will readily accommodate an irregular and unknown signal transmission medium between the two acoustic sensors.

8 Claims, 4 Drawing Sheets

U.S. PATENT DOCUMENTS

| | | | | |
|---|---|---|---|---|
| 5,969,638 | A | 10/1999 | Chin | |
| 6,006,832 | A | 12/1999 | Tubel et al. | |
| 6,088,294 | A | 7/2000 | Leggett et al. | |
| 6,222,927 | B1 | 4/2001 | Feng et al. | |
| 6,320,820 | B1 | 11/2001 | Gardner et al. | |
| 6,370,082 | B1 | 4/2002 | Gardner et al. | |
| 6,373,254 | B1 | 4/2002 | Dion et al. | |
| 6,583,729 | B1 | 6/2003 | Gardner et al. | |
| 6,714,014 | B2 | 3/2004 | Evans et al. | |
| 6,809,521 | B2 | 10/2004 | Tabarovsky et al. | |
| 6,837,332 | B1 | 1/2005 | Rodney | |
| 6,850,068 | B2 | 2/2005 | Chemali et al. | |
| 7,046,164 | B2 | 5/2006 | Gao et al. | |
| 7,158,446 | B2 | 1/2007 | Gardner et al. | |
| 7,301,473 | B2 * | 11/2007 | Shah et al. | 340/854.4 |
| 7,324,010 | B2 | 1/2008 | Gardner et al. | |
| 7,443,312 | B2 | 10/2008 | Quintero et al. | |
| 2002/0101359 | A1 | 8/2002 | Huckaba et al. | |
| 2002/0140572 | A1 | 10/2002 | Gardner et al. | |
| 2002/0153897 | A1 | 10/2002 | Evans et al. | |
| 2002/0180613 | A1 | 12/2002 | Shi et al. | |
| 2003/0006906 | A1 | 1/2003 | Gardner et al. | |
| 2003/0142586 | A1 | 7/2003 | Shah et al. | |
| 2003/0151977 | A1 | 8/2003 | Shah et al. | |
| 2003/0155925 | A1 | 8/2003 | Tabarovsky et al. | |
| 2004/0105342 | A1 | 6/2004 | Gardner et al. | |
| 2004/0155794 | A1 | 8/2004 | Gardner et al. | |
| 2004/0156264 | A1 * | 8/2004 | Gardner et al. | 367/81 |
| 2004/0206170 | A1 | 10/2004 | Chen et al. | |
| 2004/0222901 | A1 | 11/2004 | Dodge | |
| 2005/0024232 | A1 | 2/2005 | Gardner et al. | |
| 2005/0270171 | A1 | 12/2005 | Quintero et al. | |
| 2006/0001549 | A1 | 1/2006 | Shah et al. | |
| 2006/0002232 | A1 | 1/2006 | Shah et al. | |
| 2006/0028916 | A1 | 2/2006 | McMechan et al. | |
| 2006/0044939 | A1 | 3/2006 | Shah et al. | |
| 2006/0098531 | A1 | 5/2006 | Gardner et al. | |
| 2006/0114746 | A1 | 6/2006 | Gardner et al. | |
| 2007/0132606 | A1 * | 6/2007 | Reckmann et al. | 340/855.4 |
| 2008/0137481 | A1 | 6/2008 | Shah et al. | |
| 2008/0219097 | A1 | 9/2008 | Shah et al. | |
| 2010/0039286 | A1 | 2/2010 | Robbins | |
| 2010/0039898 | A1 | 2/2010 | Gardner et al. | |
| 2010/0309019 | A1 | 12/2010 | Shah et al. | |
| 2011/0164468 | A1 | 7/2011 | Robbins et al. | |

OTHER PUBLICATIONS

"US Final Office Action", dated Feb. 21, 2006, U.S. Appl. No. 10/897,559, filed Jul. 23, 2004 (Patent No. 7,158,446).

Julius O. Smith III, Physical Audio Signal Processing for Virutal Musical Instruments and Audio Effects, Center for Computer Research in Music and Acoustics (CCRMA), Stanford University, Aug. 2006 Edition, http://web.archive.org/web/20060903210314/http://ccrma.stanford.edu/~jos/pasp04/.

Julius O. Smith III, "Acoustic Modeling with Delay: Digital Waveguides", http://web.archive.org/web/20070728045149/ccrma.stanford.edu/~jos/pasp04/Digital_Waveguides.html.

Julius O. Smith III, "History of Enabling Ideas: Digital Waveguide Models", http://web.archive.org/web/20070728045110/ccrma.stanford.edu/~jos/pasp04/Digital_Waveguide_Models.html.

Julius O. Smith III, "Digital Waveguide Theory: Sampled Traveling Waves: Digital Waveguide Model", http://web.archive.org/web/20070728041917/ccrma.stanford.edu/~jos/pasp04/Digital_Waveguide_Model_I.html.

Au First Examiner'S Report, dated Dec. 18, 2008, Appl No. 2006262325, High Frequency or Multifrequency Resistivity Tool, filed Dec. 19, 2007, 2 pgs.

PCT International Preliminary Report on Patentability, dated May 22, 2008, Appl No. PCT/US06/60795, "Training for Directional Detection", filed Nov. 10, 2006 , 6 pgs.

PCT International Search Report and Written Opinion, dated Jan. 18, 2007, Appl No. PCT/06/24056, "High Frequency or Multifrequency Resistivity Tool", filed Jun. 20, 2006, 12 pgs.

PCT International Search Report and Written Opinion, dated Sep. 25, 2007, Appl No. PCT/US06/60795, "Training for Directional Detection", filed Nov. 10, 2006, 10 pgs.

U.S. Non-Final Office Action, dated May 25, 2010, Appl No. 11/993,430, High Frequency or Multifrequency Resistivity Tool, filed Dec. 20, 2007, 17 pgs.

US Final Office Action, dated Nov. 4, 2010, U.S. Appl No. 11/993,430, "High Frequency or Multifrequency Resistivity Tool", filed Dec. 20, 2007, 26 pgs.

US Non-Final Office Action, dated Apr. 12, 2011, U.S. Appl No. 11/993,430, "High Frequency or Multifrequency Resistivity Tool", filed Dec. 20, 2007, 8 pgs.

Bonner, S. et al., "A New Generation of Electrode Resistivity Measurements for Formation Evaluation While Drilling", SPWLA 35th Annual Logging Symposium, (Jun. 19, 1994), pp. 1-19.

Ritter, Rene N., et al., "High Resolution Visualization of Near Wellbore Geology Using While-Drilling Electrical images", SPWLA 45th Annual Logging Symposium,, The Netherlands, Jun. 6-9, 2004, pp. 1-13.

* cited by examiner

FIG. 1
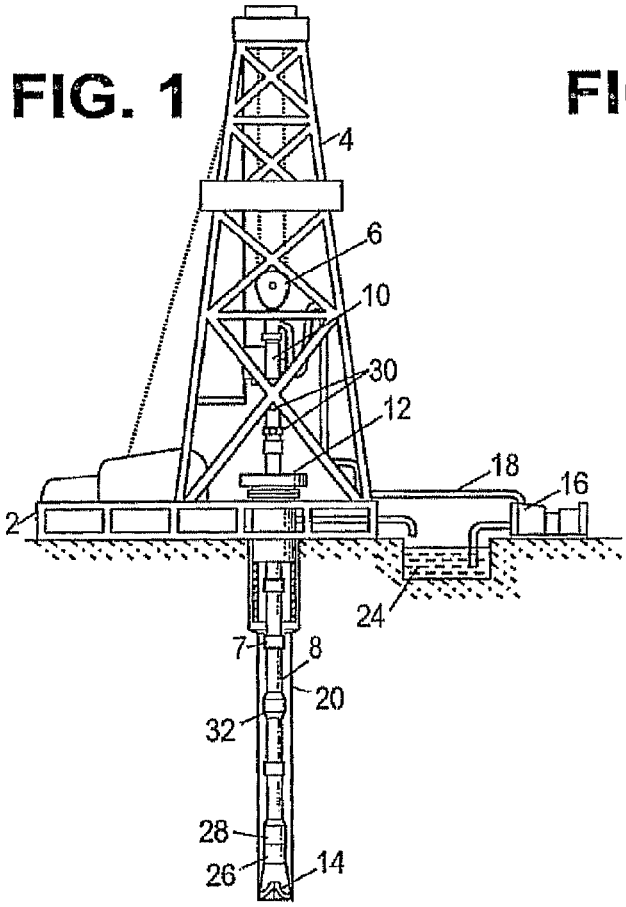
FIG. 2A
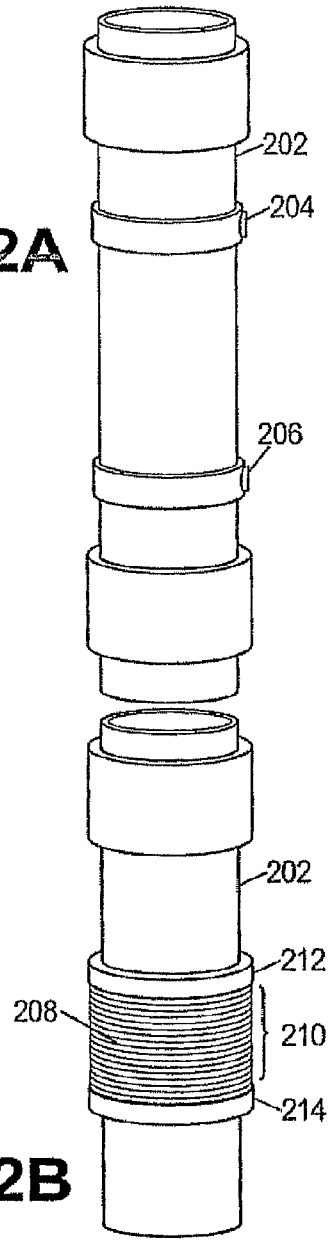
FIG. 2B

508
$y_1(t)$
FILTER
503
$y_2(t)$
506
$e_t$
EQUALIZER
510
DEMOD.
512
$\hat{u}_t$

START
QUIET DOWNHOLE?
702
N
Y
CREATE DOWNGOING SIGNAL
704
CAPTURE SENSOR SIGNALS
706
TRANSFORM SIGNALS
708
FIND RATIO OF TRANSFORMS
710
INVERSE TRANSFORM RATIO
712
RETRAINING NEEDED?
722
Y
N
RECEIVE AND RECORD TELEMETRY
720
START DIRECTIONAL DETECTION
718
SET FILTER COEFFICIENTS
716
REPEAT?
714
N
Y

TRAINING FOR DIRECTIONAL DETECTION

CROSS-REFERENCE TO RELATED APPLICATIONS

The present application claims priority to Provisional U.S. Patent Application 60/736,104, filed on Nov. 10, 2005.

BACKGROUND

Modern petroleum drilling and production operations demand a great quantity of information relating to parameters and conditions downhole. Such information typically includes characteristics of the earth formations traversed by the borehole, along with data relating to the size and configuration of the borehole itself. The collection of information relating to conditions downhole, which commonly is referred to as "logging", can be performed by several methods.

In conventional oil well wireline logging, a probe or "sonde" that houses formation sensors is lowered into the borehole after some or all of the well has been drilled, and is used to determine certain characteristics of the formations traversed by the borehole. The upper end of the sonde is attached to a conductive wireline that suspends the sonde in the borehole. Power is transmitted to the sensors and instrumentation in the sonde through the conductive wireline. Similarly, the instrumentation in the sonde communicates information to the surface by electrical signals transmitted through the wireline.

However, wireline logging can generally not be performed while the drilling assembly remains in the borehole. Rather, the drilling assembly must be removed before wireline logging can be performed. As a result, wireline logging may be unsatisfactory in situations where it is desirable to determine and control the position and orientation of the drilling assembly so that the assembly can be steered. Additionally, timely information may be required concerning the nature of the strata being drilled, such as the formation's resistivity, porosity, density and its gamma radiation characteristics. It is also frequently desirable to know other downhole parameters, such as the temperature and the pressure at the base of the borehole, for example. Once this data is gathered at the bottom of the borehole, it is necessary to communicate it to the surface for use and analysis by the driller.

In logging-while-drilling (LWD) systems, sensors or transducers are typically located at the lower end of the drill string. While drilling is in progress these sensors continuously or intermittently monitor predetermined drilling parameters and formation data and transmit the information to a surface detector by some form of telemetry. Typically, the downhole sensors employed in LWD applications are built into a cylindrical drill collar that is positioned close to the drill bit. There are a number of existing telemetry systems that seek to transmit information obtained from the downhole sensors to the surface. Of these, the mud pulse telemetry system is one of the most widely used for LWD applications.

In a mud pulse telemetry system, the drilling mud pressure in the drill string is modulated by means of a valve and control mechanism, generally termed a pulser or mud pulses. The data transmission rate, however, is relatively slow due to pulse spreading, distortion, attenuation, modulation rate limitations, and other disruptive forces, such as the ambient noise in the drill string. A typical pulse rate is less than 10 pulses per second (10 Hz). Given the recent developments in sensing and steering technologies available to the driller, the rate data can be conveyed to the surface in a timely manner, a few bits per second, is sorely inadequate.

BRIEF DESCRIPTION OF THE DRAWINGS

A better understanding of the various disclosed embodiments can be obtained when the following detailed description is considered in conjunction with the following drawings, in which:

FIG. 1 is a schematic view of an illustrative drilling environment in which an acoustic telemetry system may be employed;

FIG. 2A is a view of an illustrative acoustic receiver;

FIG. 2B is a view of an illustrative acoustic transmitter;

Figure 3:
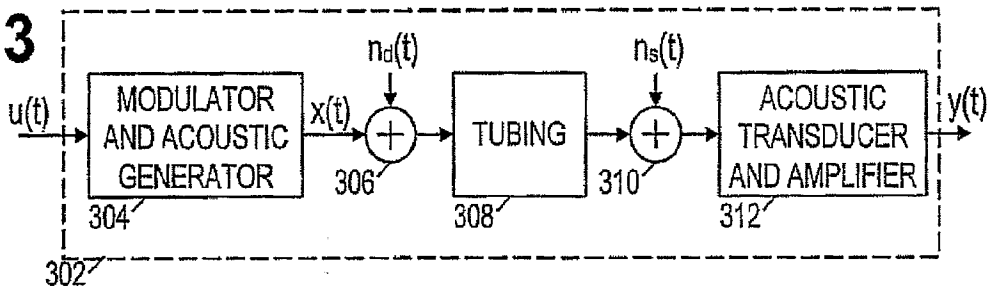
FIG. 3 is a block diagram of a first acoustic telemetry model.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION

As one method for increasing the rate of transmission of logging while drilling (LWD) telemetry data, it has been proposed to transmit the data using compressional acoustic waves in the tubing wall of the drill string rather than depending on pressure pulses in the drilling fluid. Many physical constraints present challenges for this type of telemetry. Acoustic wave propagation through the drill string encounters attenuation and scattering due to the acoustic impedance mismatch at pipe joints. The resulting transfer function is lossy and has alternating stop and pass bands. In-band noise produced by the bit and surface motor(s) produces a low signal-to-noise ratio (SNR). Typically, the downhole transmitter has significant power constraints.

Data transmission rates are limited by the SNR at the input to the telemetry receiver. A telemetry signal generated down hole is small by the time it reaches the surface because of attenuation in the drill string as it travels uphole. Although noise may be generated anywhere in the transmission channel, the largest noise component entering the telemetry receiver is usually generated by a surface source that is not attenuated by the transmission channel. In other words, most of the acoustic noise in LWD acoustic telemetry is generated by the drilling rig and that noise reaches the telemetry receiver via the top drive. This rig-generated noise will travel downward in an opposite direction to the upward traveling telemetry signal. The acoustic noise generated by the drill bit down hole will be comparatively smaller than the surface generated noise because of attenuation in the drill pipe channel, but if necessary bit noise can be further attenuated by an in-line acoustic attenuator between the drill bit and the acoustic transmitter.

U.S. patent application Ser. No. 10/897,559, filed Jul. 23, 2004, and entitled "Directional Acoustic Telemetry Receiver" by inventors Wallace Gardner, Sinan Sinanovic, Don Johnson, and Vimal Shah, discloses a directional detection method in which the downgoing noise (and echoes thereof) are completely suppressed. The disclosed method employed certain simplifying assumptions, e.g., that a signal passing in one direction between two separated surface detectors would affected only by a simple signal delay with no significant attenuation or reflections caused by impedance mismatches. In addition the disclosed method implicitly assumed that the response characteristics of the two detectors were identical. In real world applications, these assumptions often will not hold true, significantly impairing the performance of the method. Moreover, the disclosed method failed to consider design issues raised in attempting to incorporate training or adaptation to optimize system performance.

Accordingly, there is disclosed herein directional detection systems and methods that will work with an irregular and unknown signal transmission medium between two spaced acoustic detectors to suppress downgoing signals and noise and thereby to improve the SNR of signals received from the opposite direction. Moreover, it is shown how the redesigned systems and methods can be trained in the field to work with the given configuration. The disclosed systems and methods are applicable not only to the various proposed forms of acoustic telemetry, but also to mud pulse telemetry systems and to electromagnetic telemetry systems.

Turning now to the figures, FIG. 1 shows a well during drilling operations. A drilling platform 2 is equipped with a derrick 4 that supports a hoist 6. Drilling of oil and gas wells is carried out by a string of drill pipes connected together by "tool" joints 7 so as to form a drill string 8. The hoist 6 suspends a top drive 10 that is used to rotate the drill string 8 and to lower the drill string through the well head 12. Connected to the lower end of the drill string 8 is a drill bit 14. The bit 14 is rotated and drilling accomplished by rotating the drill string 8, by use of a downhole motor near the drill bit, or by both methods. Drilling fluid, termed "mud", is pumped by mud recirculation equipment 16 through supply pipe 18, through top drive 10, and down through the drill string 8 at high pressures and volumes to emerge through nozzles or jets in the drill bit 14. The mud then travels back up the hole via the annulus formed between the exterior of the drill string 8 and the borehole wall 20, through a blowout preventer (not specifically shown), and into a mud pit 24 on the surface. On the surface, the drilling mud is cleaned and then recirculated by recirculation equipment 16. The drilling mud is used to cool the drill bit 14, to carry cuttings from the base of the bore to the surface, and to balance the hydrostatic pressure in the rock formations.

In wells employing acoustic telemetry for LWD, downhole sensors 26 are coupled to an acoustic telemetry transmitter 28 that transmits telemetry signals in the form of acoustic vibrations in the tubing wall of drill string 8. An acoustic telemetry receiver array 30 may be coupled to tubing below the top drive 10 to receive transmitted telemetry signals. One or more repeater modules 32 may be optionally provided along the drill string to receive and retransmit the telemetry signals. The repeater modules 32 include both an acoustic telemetry receiver array and an acoustic telemetry transmitter configured similarly to receiver array 30 and the transmitter 28.

FIG. 2A shows an illustrative receiver array mounted on a drill string 202. The receiver array includes at least two acoustic sensors 204, 206, spaced apart along the axis of the drill string 202. Various suitable acoustic sensors are known in the art including pressure, velocity, and acceleration sensors. Sensors 204 and 206 may comprise two-axis accelerometers that sense accelerations along the axial and circumferential directions. One skilled in the art will readily recognize that other sensor configurations are also possible. For example, sensors 204 and 206 may comprise three-axis accelerometers that also detect acceleration in the radial direction.

Additional sensors may be provided 90 or 180 degrees away from the sensors shown. A reason for employing such additional sensors stems from an improved ability to isolate and detect a single acoustic wave propagation mode to the exclusion of other propagation modes. Thus, for example, a multi-sensor configuration may exhibit improved detection of axial compression waves to the exclusion of torsional waves, and conversely, may exhibit improved detection of torsional waves to the exclusion of axial compression waves. U.S. Pat. No. 6,370,082 entitled "Acoustic Telemetry System With Drilling Noise Cancellation" discusses one such sensor configuration.

Additional sensors may be spaced axially along the drill string 202. As explained further below, one reason for employing multiple, axially spaced sensors stems from an ability to screen out surface noise and improve the signal to noise ratio of the receive signal. Larger axial spacings within physical system constraints may be preferred. Another consideration, at least when tone burst signaling is employed, is the axial placement of the sensors relative to the end of the tool string U.S. Pat. No. 6,320,820, entitled "High data rate acoustic telemetry system" discusses a sensor placement strategy for such systems.

FIG. 2B shows an acoustic transmitter 208 mounted on drill string 202. Various suitable acoustic transmitters are known in the art, as evidenced by U.S. Pat. Nos. 2,810,546, 3,588,804, 3,790,930, 3,813,656, 4,282,588, 4,283,779, 4,302,826, and 4,314,365. The transmitter 208 shown in FIG. 2B has a stack of piezoelectric washers 210 sandwiched between two metal flanges 212, 214. When the stack of piezoelectric washers 210 is driven electrically, the stack expands and contracts to produce axial compression waves that propagate axially along the drill string. Other transmitter configurations may be used to produce torsional waves, radial compression waves, or even transverse waves that propagate along the drill string.

FIG. 3 shows a model 302 of an acoustic telemetry system with a single acoustic sensor. A digital or analog telemetry signal u(t) is modulated and converted to an acoustic wave signal x(t) by modulator block 304. Adder 306 adds downhole noise $n_d(t)$ to the acoustic wave signal x(t). The downhole noise is caused in part by the operation of the drill bit as it crushes formation material. The crushing action creates compressional and torsional acoustic waves that propagate along the drill string in the same manner as the acoustic telemetry signal x(t).

The propagation of the noise-contaminated telemetry signal through the drillstring is represented by block 308. Because the drill string consists of many pipe segments, compressional acoustic waves partly reflect at the acoustic impedance mismatches caused by the pipe joints. The periodic structure of the drill string results in a complex frequency response which has multiple stopbands and passbands. Adder 310 adds surface noise $n_s(t)$ to the acoustic signal that reaches the surface. The surface noise is caused at least in part by the drive motor(s) at the surface. The resulting acoustic signal is converted into a digital or analog receive signal y(t) by an acoustic transducer and amplifier block 312.

As explained in the previously-mentioned U.S. patent application Ser. No. 10/897,559, (entitled "Directional Acoustic Telemetry Receiver"), models employing a single acoustic sensor exhibit a constrained channel capacity due to the power disparity between the highly-attenuated signal and the relatively un-attenuated surface noise. Hence, designs that effectively eliminate surface noise will obtain a significant advantage. To that end, the 10/897,559 application disclosed the multiple-sensor model shown in FIG. 4, and demonstrated that the use of multiple sensors under the right conditions enables the complete suppression of surface noise. The use of multiple sensors enables downward-propagating acoustic waves (such as surface noise) to be distinguished from upward-propagating acoustic waves (such as the telemetry signals), and with this distinction, the system can be designed to suppress the downwardly-propagating waves, substantially enhancing the signal to noise ratio of the telemetry signal.

Figure 4:
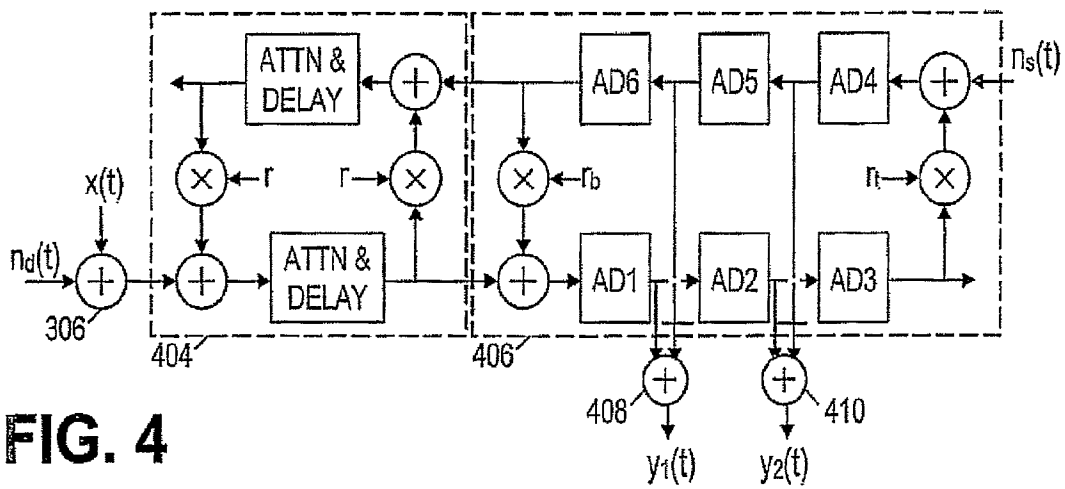
FIG. 4 is a block diagram of a second model for a multi-receiver acoustic telemetry system.

FIG. 4 shows a model of an acoustic telemetry system with multiple sensors. An adder 306 contaminates the acoustic telemetry signal x(t) with downhole noise $n_d(t)$. One or more tubing segment blocks 404 transport the acoustic waves in two directions, introducing attenuation, delays, and reflections from the ends of each tubing segment. Eventually, the upwardly-propagating acoustic waves reach a receiver tubing segment 406. The receiver tubing segment 406 also receives downwardly-propagating surface noise $n_s(t)$. The receiver tubing segment 406 includes at least two acoustic sensors. A first sensor, represented by adder 408, is sensitive to acoustic waves propagating in both directions, yielding sensor signal $y_1(t)$. Similarly, a second sensor is represented by an adder 410 that is sensitive to acoustic waves propagating in both directions, yielding sensor signal $y_2(t)$. The sensors are separated by attenuation and delay blocks AD2 (in the upward direction) and AD5 (in the downward direction).

The model of FIG. 4 may be generalized somewhat with the following equations:

$$Y_1(f)H_{X1}(f)[X(f)+N_d(f)]+H_{N1}(f)N_S(f) \quad (1)$$

$$Y_2(f)=H_{X2}(f)[X(f)+N_d(f)]+H_{N2}(f)N_S(f) \quad (2)$$

subject to the requirement that the transfer function ratios are not equal:

$$H_{X2}(f)/H_{X1}(f)\neq H_{N2}(f)/H_{N1}(f) \quad (3)$$

In this manner, the generalized model avoids assumptions regarding the attenuation and symmetry of the channel between the sensors or assumptions regarding the equivalence of the individual sensor responses.

Equations (1)-(2) can be manipulated to eliminate the surface noise $N_S(f)$:

$$[H_{N2}(f)/H_{N1}(f)]Y_1(f)-Y_2(f)=Q(f)[X(f)+N_d(f)], \quad (4)$$

where $$Q(f)=[H_{N2}(f)/H_{N1}(f)]H_{X1}(f)-H_{X2}(f). \quad (5)$$

One noteworthy aspect of equation (4) is that the surface noise can be eliminated with knowledge of the frequency-domain ratio of the sensor responses to the surface noise, i.e., $H_{N2}(f)/H_{N1}(f)$. Accordingly, various disclosed system and method embodiments perform calibration, or training, operation in which this ratio is measured. In certain embodiments, this ratio is measured during quiet periods downhole, e.g., when drilling operations have been suspended and no telemetry data is being transmitted. In accordance with equations (1)-(2), when the upward-propagating signal is essentially zero, the ratio of the sensor signals in response to a broadband, downward-propagating, training signal yields the desired ratio:

$$K(f)=Y_{2T}(f)/Y_{1T}(f)=H_{N2}(f)/H_{N1}(f) \quad (6)$$

It can be shown that even when the upward-propagating signal is not zero during training, some performance gain still results due to the imperfect suppression of surface noise.

Figure 5:
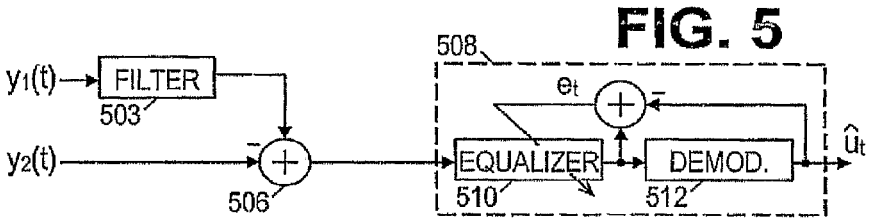
FIG. 5 is a block diagram of an illustrative receiver configuration suitable for training.

FIG. 5 shows a receiver configuration in which a first sensor signal $y_1(t)$ is filtered by filter block 503 before being combined with a second sensor signal $y_2(t)$ by adder 506. When filter 503 is set to have the filter characteristic given by equation (6), the output from adder 506 is given by equation (4), i.e., the output is a directional signal in which the surface noise is suppressed. A receiver block 508 receives and demodulates the signal to construct a digital estimate $\hat{u}_t$ of the original telemetry signal u(t). Many suitable equalizers that may be used in receiver block 508, such as a linear equalizer, a fractionally-spaced equalizer, a decision feedback equalizer, and a maximum likelihood sequence estimator. These are described in detail in Chapter 6 (pp. 519-692) of John G. Proakis, *Digital Communications*, Second Edition, McGraw-Hill Book Company, New York, (c)1989. Each of the equalizers may be implemented in adaptive form to enhance their performance over a range of variable channel conditions. Filter adaptation is well known and is described in various standard texts such as Simon Haykin, *Adaptive Filter Theory*, Prentice-Hall, Englewood Cliffs, (c)1986.

FIG. 5 shows receiver block 508 as having an adaptive equalizer 510 followed by a demodulator 512. Demodulator 512 processes the filtered receive signal to estimate which channel symbols have been transmitted. The coefficients of adaptive equalizer 510 are dynamically adjusted to minimize the error between the input and output of the demodulator 512. In some embodiments, adaptation may also be applied to the coefficients of filter 503 to minimize the error between the input and output of the demodulator 512.

Figure 6:
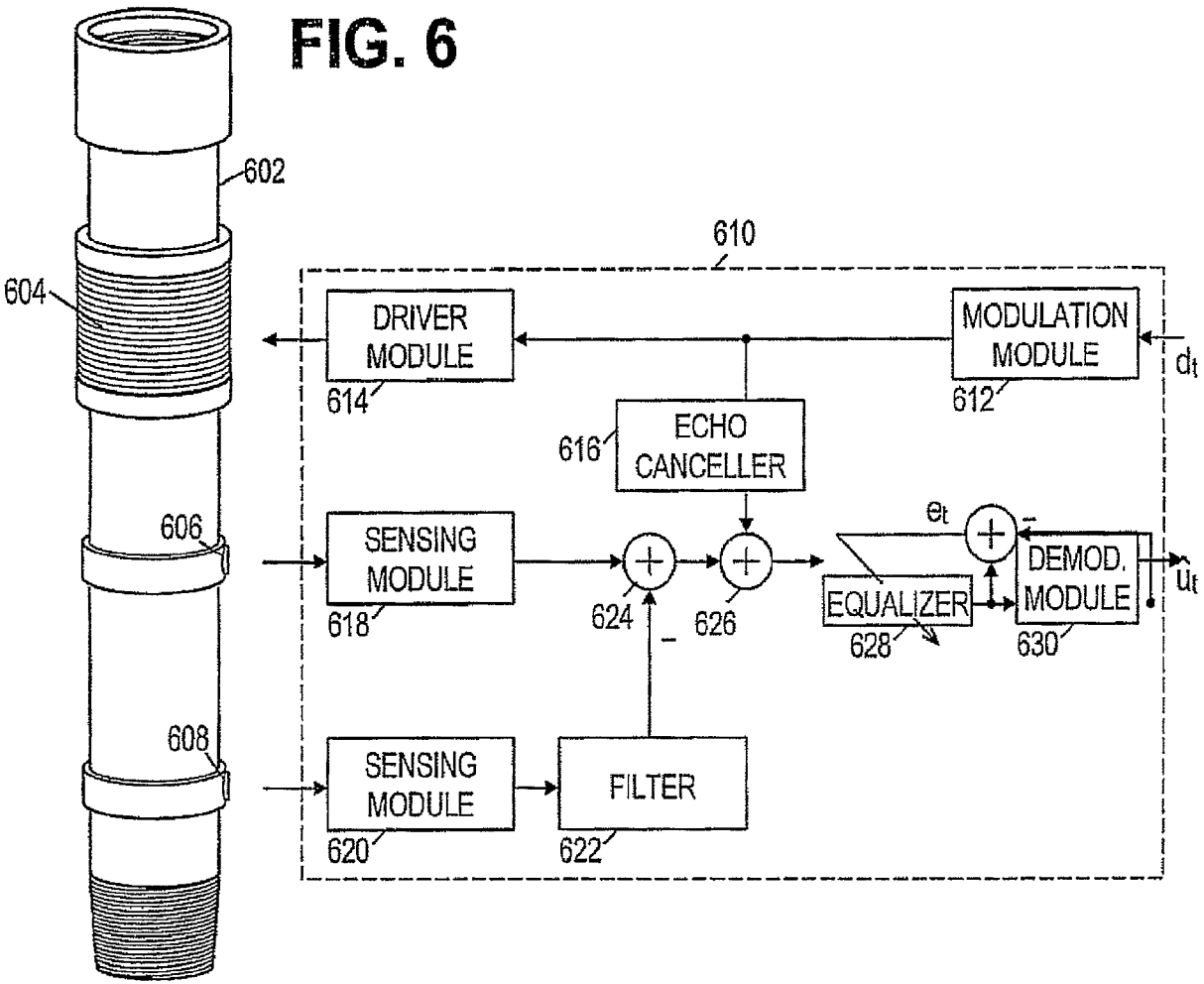
FIG. 6 shows an illustrative transceiver embodiment in accordance with some disclosed embodiments.

Directional detection can be used in full-duplex systems to enhance performance. FIG. 6 shows an illustrative transmitter/receiver ("transceiver") embodiment 602. Transceiver 602 includes an acoustic transmitter 604, at least two acoustic sensors 606, 608, and transceiver electronics 610. Transceiver electronics 610 may be implemented as one or more application specific integrated circuits (ASICs), or as a digital processor that executes software to perform the various functions shown.

Transceiver electronics 610 include a modulation module 612 configured to convert a downlink datastream $d_t$ into a transmit signal. A driver module 614 amplifies the transmit signal and provides the amplified signal to transmitter 604, (In digital embodiments of electronics 610, the driver module 614 may also provide digital-to-analog conversion.) An echo canceller 616 processes the transmit signal to estimate echoes not otherwise accounted for by the receive chain.

The receive chain in transceiver electronics 610 includes sensing modules 618, 620 that buffer signals detected by corresponding sensors 606, 608. The sensing modules may be configured to compensate for non-linearities or other imperfections in the sensor responses. Sensing modules 618, 620 may be further configured to provide analog-to-digital signal conversion. The received signal from one sensor module is filtered by filters 622, and the filter output is combined with the received signal from the other sensor module by adder 628 to provide directional detection as described previously. Another adder 630 may combine the directional signal from adder 628 with an estimated echo signal from echo canceller 616 to obtain an "echo-cancelled" signal. An adaptive equalizer 628 maximizes the signal to noise ratio for demodulator 630, and demodulator 630 estimates the uplink data stream. In some embodiments, modulator 612 and demodulator 630 implement discrete multi-tone (DMT) modulation.

Figure 7:
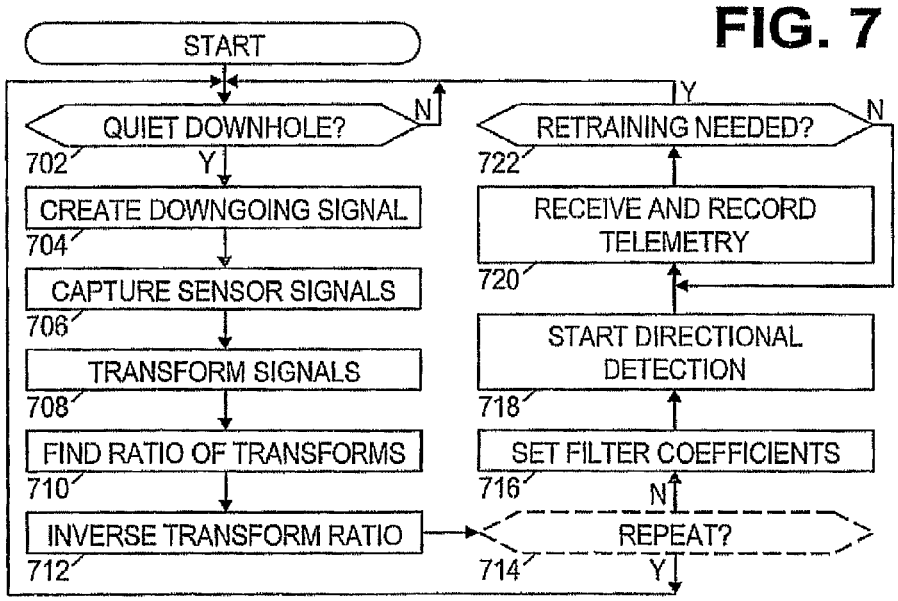
FIG. 7 is a flow diagram of an illustrative telemetry method in accordance with some disclosed embodiments.

FIG. 7 shows an illustrative telemetry method. Once being activated, the surface electronics wait in block 702 for a quiet period downhole. Such a quiet period may be manually indicated or may be automatically detected. In some embodiments, signals from the acoustic sensors are monitored and combined in accordance with a predetermined (non-optimized) directional detection configuration. Quiet periods may be identified as those intervals when the energy of upward-going signals (as measured by the predetermined detection configuration) fall below a preset threshold. Such quiet periods may correspond to a pause in drilling operations.

In block 704 a broadband downgoing signal is generated. In some embodiments, an impulse-type signal is created by striking the tubing above the receivers with a hammer or other metallic object. With monitoring of the acoustic sensor signals, such an impulse may be readily detected and processed. In full-duplex signaling environments, the transmitter is activated to send a frequency-sweep signal or other form of broadband signal. In still other embodiments, ambient noise from surface equipment and/or personnel activities is sufficient for training. In such embodiments, the frequency content of received signal energy may be monitored to select intervals where sufficient frequency energy is present, or as an alternative, to combine frequency information from different intervals to assure adequate training.

In block 706, acoustic sensor signals $y_{1T}(t)$ and $y_{2T}(t)$ are captured in digital form during a selected interval. The selected interval is chosen to include the broadband downgoing signal and preferably contains sufficient signal energy to assure training at all frequencies of interest. If desired, multiple intervals may be captured and combined, or separately analyzed and the frequency information combined.

In block 708, the captured signals are transformed into the frequency domain, and in block 710, the ratio of the frequency domain signals is determined in accordance with equation (6). The resulting frequency domain characteristic defines a filter, which in some embodiments is determined with an inverse transform in block 712. In block 714, a decision is made whether to repeat blocks 702-714. Such repetition may be warranted if the filter coefficients appear ill-defined or if multiple repetitions are deemed desirable to improve reproducibility by combining multiple estimates of the filter coefficients. In block 716, the coefficients of filter 503 are set. In some embodiments, the filter parameters (e.g., length, maximum coefficient value) may be constrained, requiring block 716 to determine an approximation to the desired filter.

In block 718, directional detection commences in accordance with equation (4). In other words, one of the acoustic sensor signals is filtered by a filter having a frequency response approximately equal to K(f), before being combined with the other acoustic sensor signal. The resulting signal is processed by a receiver module in block 720 to receive and record the telemetry data. In block 722, a check is performed to determine whether retraining is needed. Such a need may be indicated by an increase in noise energy as indicated by error signal $e_t$, or by an increase in error rates as indicated by a checksum or by an error correction code. Adaptive equalization may be employed to track small variations during ongoing telemetry operations, while large changes may indicate a need to start again with block 702.

It is noted that the operation of filter 503 (FIG. 5) and filter 622 (FIG. 6) has been described as occurring in the time domain. In system embodiments that employ DMT modulation, the demodulation module 512 would generally include a discrete Fourier transform operation, with demodulation decisions occurring in the frequency domain. In a variation of these system embodiments, the discrete Fourier transform operation may be performed first, enabling the filtering operation to be approximated by multiplication in the frequency domain. Because of the difference between circular convolution and time domain filtering, some degradation in filter performance may be expected. However, this degradation may be offset by the ability to precisely match the desired frequency response of the filter.

Numerous other variations and modifications will become apparent to those skilled in the art once the above disclosure is fully appreciated. For example, the foregoing description was made in the context of a drilling operation, but such acoustic telemetry may also take place through coiled tubing, production tubing or any other length of acoustically transmissive material in or out of a borehole. Repeaters may be included along the drill string to extend the signaling range. In addition to LWD and producing while drilling, the disclosed telemetry systems can be employed for production logging using permanently installed sensors, smart-wells, and drill stem testing. It is intended that the following claims be interpreted to embrace all such variations and modifications.

What is claimed is:

1. A telemetry method that comprises:

detecting an acoustic impulse originating from a first direction with at least two detectors spaced apart along a drilling string to obtain first and second training signals, wherein the acoustic impulse is generated by a metallic object striking the drilling string;

determining a filter response from the first and second training signals; and applying the filter response to a received signal from a first of the at least two detectors;

combining the filtered received signal with a received signal from a second of the at least two detectors to obtain a directional signal having reduced signal energy originating from the first direction as compared to the received signals from the first and second detectors.

2. The telemetry method of claim 1, wherein said determining comprises:

obtaining a Fourier transform of each of the first and second training signals.

3. The telemetry method of claim 1, wherein the filter response has a frequency spectrum proportional to a ratio of a Fourier transform of the second training signal to a Fourier transform of the first training signal.

4. The telemetry method of claim 1, wherein the directional signal represents an upgoing telemetry signal with the substantial exclusion of a downgoing noise signal.

5. The telemetry method of claim 4, wherein the upgoing telemetry signal comprises an acoustic signal.

6. The telemetry method of claim 5, wherein the upgoing telemetry signal comprises a discrete multi-tone (DMT) modulated signal.

7. The telemetry method of claim 1, further comprising:

processing the directional signal to extract and record digital data.

8. The telemetry method of claim 7, wherein said processing comprises:

demodulating an equalized directional signal to estimate the digital data; and adaptively equalizing the directional signal to minimize error between the equalized directional signal and the digital data.

* * * * *